US009957076B2

(12) United States Patent
Tung et al.

(10) Patent No.: US 9,957,076 B2
(45) Date of Patent: May 1, 2018

(54) OUTSERT FOR A METAL CONTAINER

(75) Inventors: Thomas T. Tung, Inverness, IL (US); William J. Walsh, Lombard, IL (US)

(73) Assignee: REXAM BEVERAGE CAN COMPANY, Chicago, IL (US)

( * ) Notice: Subject to any disclaimer, the term of this patent is extended or adjusted under 35 U.S.C. 154(b) by 1227 days.

(21) Appl. No.: 12/014,506

(22) Filed: Jan. 15, 2008

(65) Prior Publication Data

US 2009/0178995 A1 Jul. 16, 2009

(51) Int. Cl.

| | |
|---|---|
| ***B65D 1/46*** | (2006.01) |
| ***B65D 1/02*** | (2006.01) |
| ***B65D 8/00*** | (2006.01) |
| ***B65D 23/08*** | (2006.01) |

(52) U.S. Cl.

CPC ..... *B65D 1/0246* (2013.01); *B65D 7/04* (2013.01); *B65D 23/0857* (2013.01)

(58) Field of Classification Search

CPC ..... B65D 1/0246; B65D 1/023; B29C 49/06; B29C 49/50; B29C 2793/009

USPC ..... 215/40, 329–331, 42–44, 274, 321, 386; 220/619, 641, 646

See application file for complete search history.

(56) References Cited

U.S. PATENT DOCUMENTS 2,148,169 A 2/1939 Merolle
2,337,616 A 12/1943 McManus et al.
2,574,239 A * 11/1951 Bell ..... B65D 50/06 215/206
3,160,301 A * 12/1964 Milbourne ..... B65D 50/068 215/216
3,219,004 A 11/1965 Wilton
3,402,842 A * 9/1968 Millian ..... B65D 50/061 215/206
3,628,679 A * 12/1971 Armour ..... B65D 50/065 215/221
3,704,677 A 12/1972 Moller
3,830,390 A * 8/1974 Gach ..... B65D 50/041 215/220
3,844,443 A 10/1974 Cudzik
(Continued)

FOREIGN PATENT DOCUMENTS

EP 0549987 A1 7/1993

OTHER PUBLICATIONS

REXAM Beverage Can Company, PCT International Search Report, dated Mar. 31, 2009 by the European Patent Office as International Searching Authority.

*Primary Examiner* — Fenn C Mathew
*Assistant Examiner* — Cynthia Collado
(74) *Attorney, Agent, or Firm* — Greer, Burns & Crain, Ltd.

(57) ABSTRACT

A lug-type resealable beverage container is described. The lug-type resealable beverage container has a metallic containment vessel, an annular sleeve, and a metallic cap. The metallic containment vessel has a containment area for receiving a liquid. The containment vessel has a closed end separated from an open end by a tubular sidewall. The annular sleeve is joined about the containment vessel adjacent the open end and has first and second lug members extending radially outwardly. The metallic cap has first and second lug members for cooperative engagement with the first and second lug members on the sleeve. Cooperative engagement between the first and second mating lugs and the first and second lug members encloses the liquid within the containment vessel.

15 Claims, 4 Drawing Sheets

(56) References Cited

U.S. PATENT DOCUMENTS

| | | | | | |
|---|---|---|---|---|---|
| 3,868,038 | A | | 2/1975 | Hadley et al. | |
| 3,944,102 | A | * | 3/1976 | Grau | B65D 50/041 215/214 |
| 4,006,836 | A | * | 2/1977 | Micallef | B65D 50/048 215/218 |
| 4,433,789 | A | * | 2/1984 | Gibilisco | B65D 50/041 215/220 |
| 4,844,270 | A | | 7/1989 | Coffman | |
| 5,052,576 | A | | 10/1991 | Budenbender | |
| 5,190,181 | A | | 3/1993 | Budenbender | |
| 5,322,177 | A | | 6/1994 | Coggings | |
| 5,727,704 | A | * | 3/1998 | Glynn | B65D 50/04 215/221 |
| 5,822,843 | A | | 10/1998 | Diekhoff et al. | |
| 5,881,907 | A | | 3/1999 | Schutz | |
| 6,010,028 | A | * | 1/2000 | Jordan | B21D 51/26 215/44 |
| 6,082,944 | A | | 7/2000 | Bachmann et al. | |
| 6,105,807 | A | | 8/2000 | McCrossen | |
| 6,543,636 | B1 | | 4/2003 | Flecheux et al. | |
| 6,779,677 | B2 | | 8/2004 | Chupak | |
| 6,959,830 | B1 | | 1/2005 | Kanou et al. | |
| 6,907,653 | B2 | | 6/2005 | Chupak | |
| 7,014,060 | B2 | | 3/2006 | Richardson | |
| 7,069,763 | B2 | | 7/2006 | Cook et al. | |
| 7,171,840 | B2 | | 2/2007 | Kanou et al. | |
| 2005/0051554 | A1 | * | 3/2005 | Cook | B65D 79/005 220/293 |
| 2006/0011633 | A1 | | 1/2006 | Cook et al. | |
| 2007/0062952 | A1 | | 3/2007 | Kobayashi et al. | |

* cited by examiner

OUTSERT FOR A METAL CONTAINER

TECHNICAL FIELD

The invention relates to beverage containers having resealable closures. More particularly, the present invention relates to beverage containers having lug-type closures sealable to an outsert located about the open end of the beverage container.

BACKGROUND OF THE INVENTION

It is known to produce metal beverage containers having a screw-on closure cap. An open end of the container may be opened and resealed using the screw-on closure cap. A number of references teach such screw-on closure caps with many different features and differing levels of success.

One method involves production of can body having a necked-in upper portion terminating at a threaded open end. These containers generally resemble screw top bottles. The threads are typically mechanically formed using the excess metal at the open end of the can body. Formation of the threads, however, is a difficult manufacturing process.

To ease this difficulty, a method of providing a threaded container has been introduced which includes providing an annular outsert at the open end of the container. The outsert is produced from a polymeric material or the like and includes threads on an outer surface. The threaded outer surface cooperates with a threaded surface on a closure cap to seal the cap to the container. The outserts, however, have a tendency to slip vertically or rotate about the container. Because of this, many solutions have been introduced to prevent outserts from unwanted movement on a container body, none of which achieving great success.

Recently, lug-type resealable closure systems have been introduced into the beverage market. Such closures are described in U.S. Pat. No. 6,082,944, issued to Bachman et al. These closure systems a set of elongated lugs located about the container, at an upper neck portion. These lugs cooperate with a second set of inwardly extending lug members formed in a curled rim of a cap member. When the cap member is attached to the upper neck portion, the cooperating lug members draw the cap against a curled seal rim, of the container. These closure systems overcome some of the drawbacks of the threaded closures because it avoids the necessity for the relatively expensive operation of threading the wall of the container body and also enables the use of a container which has a very short skirt and therefore requires less material then the relatively long-skirted caps usually employed as a screw closure. However, the lugs are still difficult to form. Therefore, a lug-type closure system that can be reliably manufactured while overcoming the problems associated with fully threaded closures and providing a resealable closure cap is needed.

The present invention is provided to solve the problems discussed above and other problems, and to provide advantages and aspects not provided by prior containers of this type. A full discussion of the features and advantages of the present invention is deferred to the following detailed description, which proceeds with reference to the accompanying drawings.

SUMMARY OF THE INVENTION

A first aspect of the present invention is directed to a lug-type resealable beverage container. The lug-type resealable beverage container comprises a metallic containment vessel, an annular sleeve, and a metallic cap. The containment vessel has a containment area for receiving a liquid and comprises a closed end separated from an open end by a tubular sidewall. The annular sleeve is joined about the containment vessel adjacent to the open end and has first and second lug members extending radially outwardly. The sleeve may be produced from a polymeric material. The metallic cap has first and second mating lugs for cooperative engagement with the first and second lug members on the sleeve wherein cooperative engagement of the first and second mating lugs with the first and second lug members encloses the liquid within the containment vessel.

The containment vessel may further comprise a captivation member. The annular sleeve may have an inner surface adjacent the containment vessel and an outer surface including the first and second lug members, the inner surface having a radially inwardly extending bead in an engagement with the captivation member. The captivation member may be a radially inwardly extending detent formed in the containment vessel. The detent may have a quadrilateral shape. The quadrilateral shape may be a rectangle.

The containment vessel may further comprise a second captivation member for cooperative engagement with a second radially inwardly extending bead of the sleeve. The beads and the captivation members may have complimentary shapes. The beads may fit completely within the captivation members. Portions of the inner surface of the annular sleeve adjacent the bead may be in engagement with the containment vessel.

A second aspect of the present invention is directed to a beverage container. The beverage container comprises a metallic containment vessel and an annular sleeve. The metallic containment vessel has a containment area for receiving a liquid. The containment vessel comprises a closed end separated from an open end by a tubular sidewall. The containment vessel further comprises a captivation member adjacent the open end. The annular sleeve is joined about the containment vessel adjacent to the open end. The sleeve comprises an inner surface adjacent the containment vessel. The inner surface has a radially inwardly projecting bead. At least a portion of the bead is located within the captivation member. The captivation member may be a radially inwardly extending detent. The bead may be located entirely within the detent. A portion of the inner wall adjacent the bead may be in engagement with the containment vessel.

The containment vessel may further comprise a second detent. The sleeve may further comprise a second bead. The second bead may be located entirely within the second detent.

The annular sleeve may comprise first and second lug members extending radially outwardly from an outer surface.

The beverage container may further comprise a cap for covering the open end of the containment vessel. The cap may comprise first and second mating lugs for cooperative engagement with the first and second lug members of the annular sleeve. Cooperative engagement between the lug members and the mating lugs attaches the cap to the containment vessel.

A third aspect of the present invention is directed to a resealable beverage container. The resealable beverage container comprises a metallic containment vessel, an annular polymeric sleeve, and a metallic cap. The containment vessel has a containment area for receiving a liquid. The containment vessel comprises a closed end separated from an open end by a tubular sidewall. The containment vessel further comprises a captivation member adjacent the open end. The sleeve is joined about the containment vessel adjacent to the open end. The sleeve has an inner surface and an outer surface. The inner surface is adjacent the containment vessel and comprises a radially inwardly projecting bead. At least a portion of the bead is located within the captivation member. The outer surface comprises first and second elongated, radially outwardly extending lugs. The metallic cap is for covering the open end of the containment vessel and comprises first and second radially inwardly extending mating lugs for cooperative engagement with the first and second lugs on the annular sleeve.

The captivation member may be a radially inwardly extending detent. The bead may fit entirely within the detent.

Another aspect of the present invention is directed to an annular sleeve for placement about a containment vessel adjacent an open end thereof. The annular sleeve comprises an inner surface and an outer surface. The inner surface is positioned about a longitudinal axis. The inner surface has an out-of-round cross-section along every plane perpendicular to the longitudinal axis. The outer surface is opposite the inner surface and has a plurality of lug members spaced thereon. The outer surface may have a round cross-section along a plane perpendicular to the longitudinal axis. The inner surface may have an oval cross-section shape along at least one plane perpendicular to the longitudinal axis.

Another aspect of the present invention is directed to a beverage container. The beverage container comprises a metallic containment vessel and an annular sleeve. The metallic containment vessel has a containment area for receiving a liquid and is centered about a longitudinal axis. The containment vessel comprises a closed end separated from an open end by a tubular sidewall. The annular sleeve is joined about the containment vessel adjacent the open end. The sleeve comprises an inner surface adjacent the containment vessel and an outer surface opposite the inner surface. The inner surface has a cross-sectional shape along every plane perpendicular to the longitudinal axis different or dissimilar from a corresponding cross-sectional shape of the outer surface. The outer surface may have a round cross-section along at least one plane perpendicular to the longitudinal axis and the inner surface may have an oval cross-section shape along at least one plane perpendicular to the longitudinal axis.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
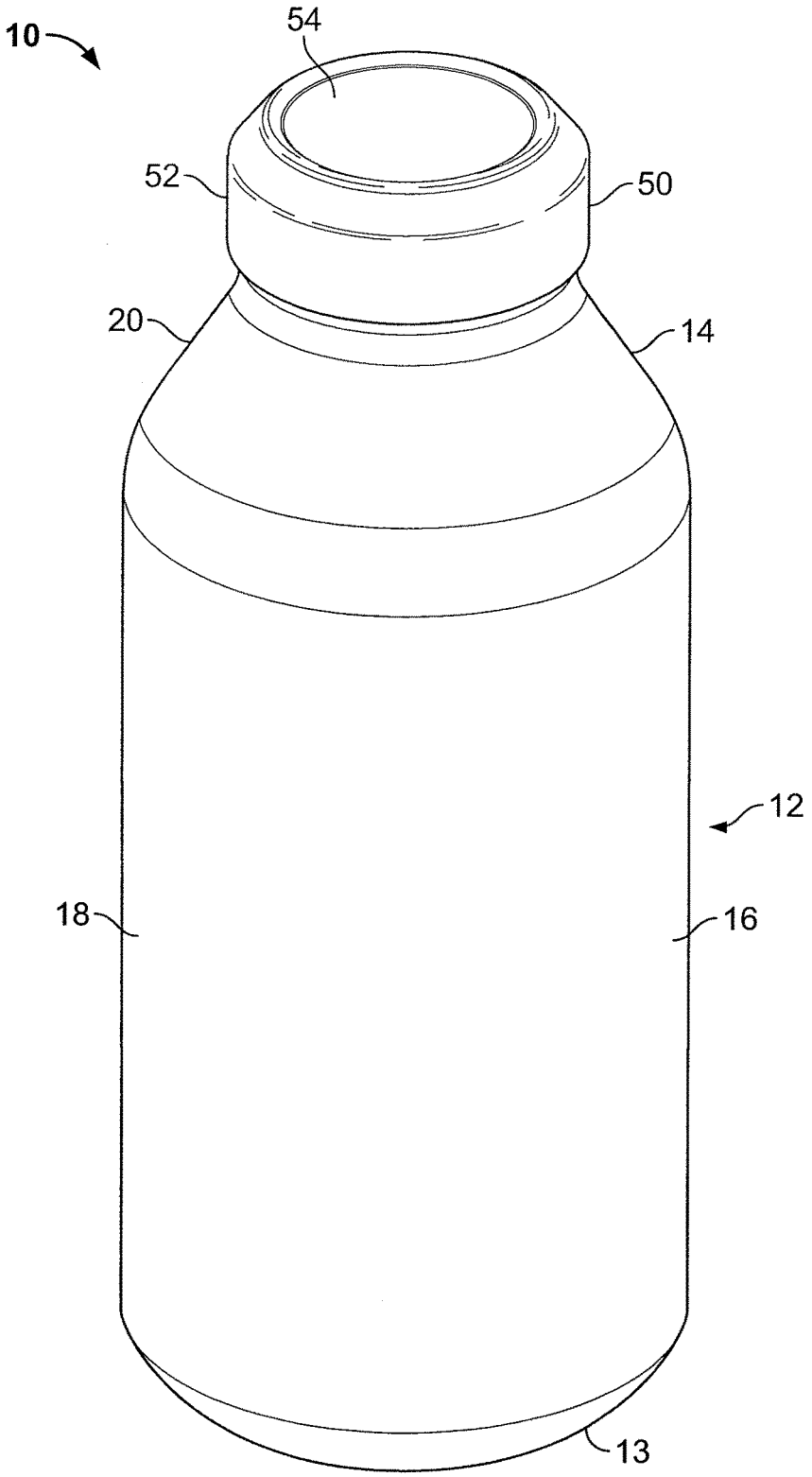
FIG. 1 is a perspective view of a container of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring generally to the figures, a beverage container 10 of the present invention is illustrated. The beverage container 10 is preferably a resealable beverage container and more preferably a resealable container having a lug-type closure assembly.

Figure 2:
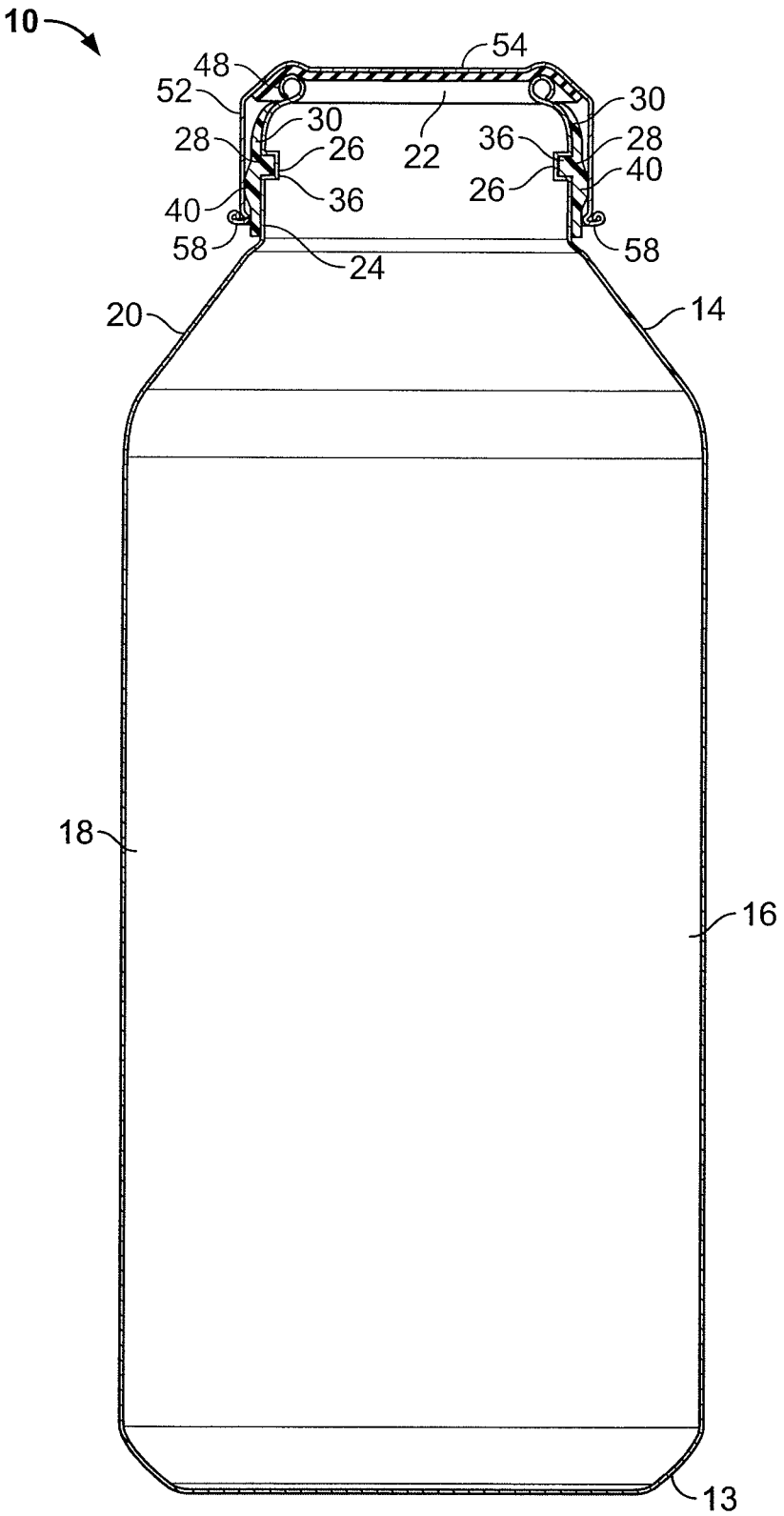
FIG. 2 is a cross-sectional view of a container of the present invention.
Figure 3:
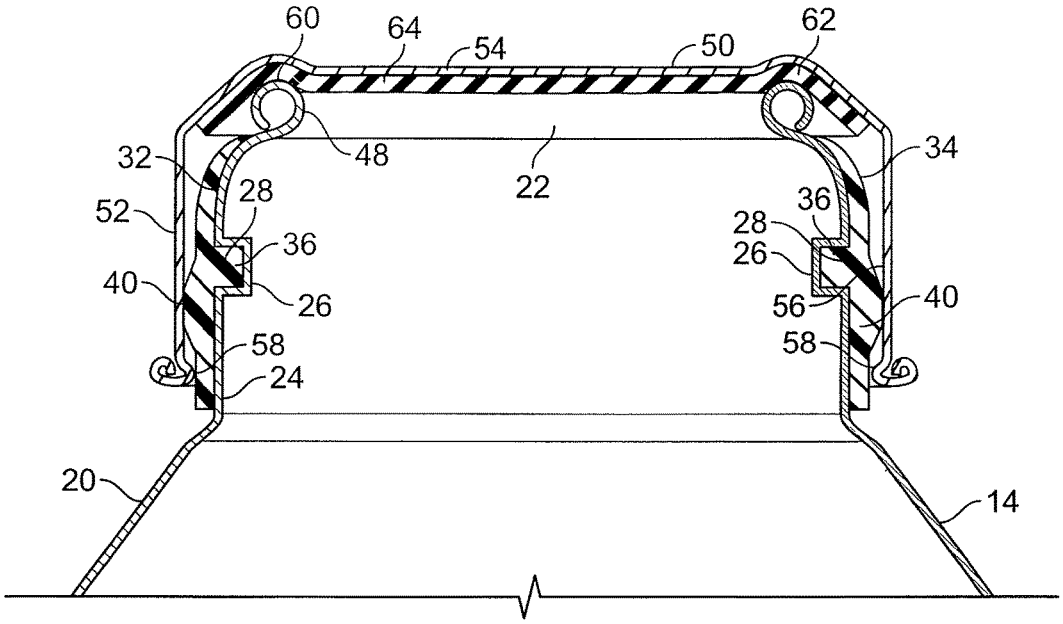
FIG. 3 is a magnified portion of FIG. 2.
Figure 4:
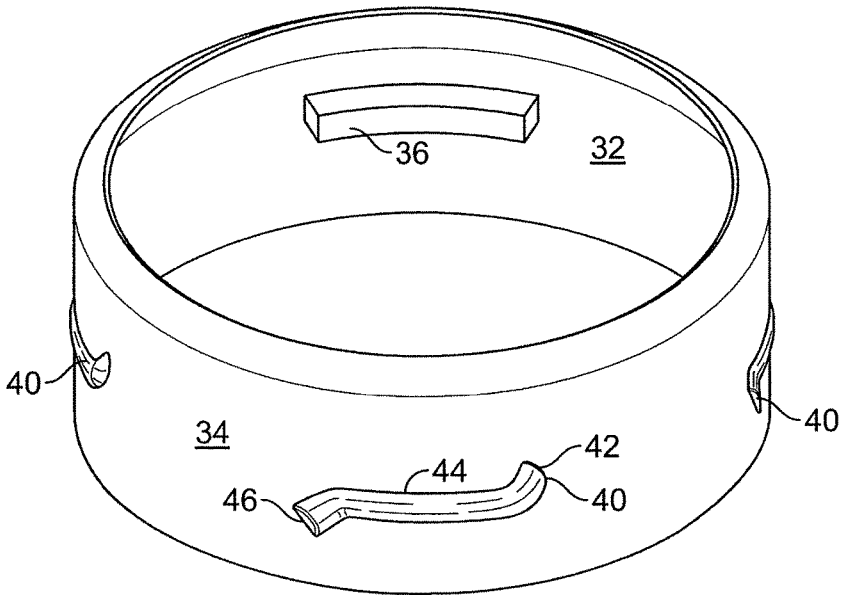
FIG. 4 is a sleeve or outsert of the present invention.

Referring to FIGS. 1 and 2, the beverage container 10 includes a containment vessel 12. The containment vessel 12 has a closed bottom end 14 and an open upper end 14 joined by a tubular sidewall 16 generally produced from a metallic material such as steel or aluminum or an aluminum alloy. The bottom end 14 may be a separate member but is preferably integrally formed with the sidewall 16 by a draw and iron process commonly used in the beverage container industry. This portion of the containment vessel 12 defines a containment area 18 for holding a liquid beverage and is typically called a container body. The upper portion 14 of the containment vessel 12 includes a necked-in region 20 which may terminate at an opening 22 as shown in FIG. 2.

Alternatively, a can end may be attached to the upper portion of the containment vessel by a process called seaming, and the can end may include the open end of the containment vessel. Such a configuration is described in U.S. Pat. No. 6,082,944 which is hereby incorporated by reference as if fully set forth herein. Either configuration may be utilized without departing from the spirit of the invention.

A reduced diameter cylindrical portion 24 is located adjacent the opening 22 of the containment vessel 12. The cylindrical portion 24 includes one or more captivation members 26, preferably a plurality of captivation members 26 equally spaced about the circumference of the cylindrical portion 24. These captivation members 26 are preferably quadrilateral in shape, more preferably rectangular. While the term "rectangular" is used to describe the shape of the captivation member 26, one of ordinary skill would recognize that sharp corners are to be avoided in metal forming. Thus, any corners of the rectangular-shaped captivation member 26 will have rounded corners to lower the components of stress in those regions.

Each captivation member 26 has an opening 28 the purpose of which will be clear upon further description. The captivation member 26 may be a receiver or an aperture, but is preferably a radially inwardly extending detent formed of the cylindrical portion material. As illustrated, the detent has somewhat tightly radiused corners and appears substantially C-shaped in cross-section.

The beverage container 10 further includes a sleeve 30 attached adjacent the open end 14 of the containment vessel 12 about the cylindrical portion 24. Accordingly, the sleeve 30 has an annular shape. The term "annular" is intended to broadly a sleeve 30 having a ring-shape with an interruption or void between opposing ends. However, the annular sleeve 30 is preferably a continuous ring with no interruption or space between opposing ends. The sleeve 30 has an inner surface 32 adjacent the cylindrical portion 24 and an outer surface 34. The sleeve 30 preferably fits snuggly about the cylindrical portion 24 in a manner that will be explained in more detail below.

The inner surface 32 of the sleeve 30 has a radially inwardly extending bead 36, preferably formed of the sleeve material which is preferably a polymeric material. The sleeve 30 generally includes an equal number of beads 36 as the containment vessel 12 has captivation members 26. Thus, the sleeve 30 has one or more beads 36, preferably a plurality of equally space beads 36. At least a portion of each bead 36 fits within a corresponding captivation member 26. The bead 36 is preferably adapted, as in sized and shaped, to fit snuggly within its captivation member 26. Accordingly, each bead 36 has a shape complimentary to its captivation member 26. Each bead 36 most preferably fits snuggly and entirely within its captivation member 26 or is molded within its captivation member 26 wherein adjacent portions of the inner surface 32 of the sleeve 30 engage portions of the containment vessel 12 surrounding the captivation member 26. Most preferably, the entire inner surface 32 of the sleeve 30 is engaged with the reduced diameter cylindrical portion 24 of the containment vessel 12, including the beads 36 within the captivation members 26.

The outer surface 34 of the sleeve has a lug-type closure assembly. This assembly includes a plurality of radially outwardly extending lug members 40. The lug members 40 are equally spaced about the circumference of the sleeve 30 and have a generally elongated, curvilinear shape. More particularly, the lug members 40 have a leading portion 42 angled upwardly toward the opening 22 of the containment vessel 12, an intermediate portion 44 that is substantially linear along a horizontal plane, and a trailing portion 46 that is angled downwardly relative to the opening 22 of the containment vessel 12.

The open end 14 of the containment vessel 12 further has a flange 48 defining the pour opening 22. The flange 48 may be formed over, or at least partially over, a top edge of the sleeve 30.

One aspect of this invention is to provide a resealable closure including a removable cap 50. Accordingly, the beverage container 10 further includes a removable cap 50 for sealing a liquid within the containment vessel 12. As will be described below, the cap 50 can be used to reseal the liquid within the containment vessel 12.

The cap 50 includes a substantially cylindrical portion 52 closed at one end by a top panel 54. An inner wall 56 of the cylindrical portion 52 includes one or more radially inwardly extending mating lugs 58, preferably a plurality of spaced mating lugs 58 corresponding to the number of lug members 40 on the sleeve 30. In use, the cooperating mating lugs 58 of the cap 50 and the lug members 40 of the sleeve 30 draw the top panel 52 against the curled flange 48 of the containment vessel 12 and compress a seal 60 against the flange 48 and possibly upper portion of the sleeve 30. The seal 60 is generally an annular O-ring 62 molded as a peripheral part of a thin polymeric disk 64 which is attached to the underside of top panel 52.

The beverage container 10 described herein provides many advantages over the prior art. The sleeve 30 of the present invention is an improvement over sleeves described in prior art publications, and the lug-type closure assembly provides advantages over typical threaded closures described in the prior art.

The combination of the beads 36 and the captivation members 34 provides many advantages over the prior art. First, as the beads 36 are located at least partially within the captivation members 26, movement of the sleeve 30 on the cylindrical portion 24 of the containment vessel 12 is eliminated. Second, because the captivation member 26 is depressed within the cylindrical portion 24, the captivation member 26 cannot be damaged or flattened if the sleeve 30 is improperly aligned on the cylindrical portion 24. Third, the depressed captivation member 26 and bead 36 combination allows for sharper radiused shapes of the both the captivation member 26 and the bead 36 which allows a much more accurate and secure fit between the two components and less sleeve 30 movement on the cylindrical portion 24. Finally, because the beads 36 and captivation members 26 are matched on the inner surface 32 of the sleeve 30 and cylindrical portion 24, respectively, a flange 48 along the upper edge of the open end 14 may be uniform rather than having interruptions as described in the prior art. One of ordinary skill in the art would readily recognize the significant contribution the present invention makes over the prior art containers of this kind.

The lug-type closure assembly provides advantages over prior art threaded closures as well. First, the cap 50 of the lug-type closure assembly is easier to reseal on the containment vessel 12. Threaded caps requires several turns to reseal a beverage within the containment vessel; the lug-type assembly only requires a partial turn dictated by the length of the linear portion of the lug member 40 on the sleeve 30. Second, the lug-type assembly is easier to manufacture because the lugs 40,58 can be larger than typical threads, and the lugs 40,58 do not need to spiral about the entire circumference of the containment vessel 12 and/or vertically overlap like typical threads. Third, the lug-type assembly does not require an annular ring from which the cap 50 must be separated to open the container or perforated metal tabs to form a seal with the containment vessel 12.

Figure 5:
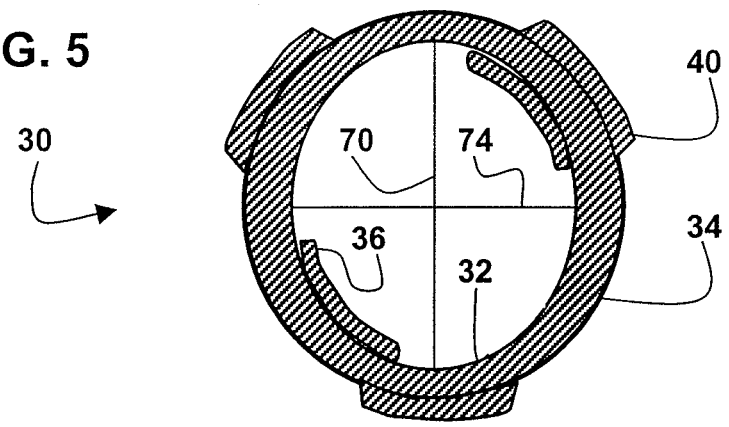
FIG. 5 is a cross-sectional view of an alternative sleeve or outsert of the present invention taken perpendicular to a center longitudinal axis.
Figure 6:
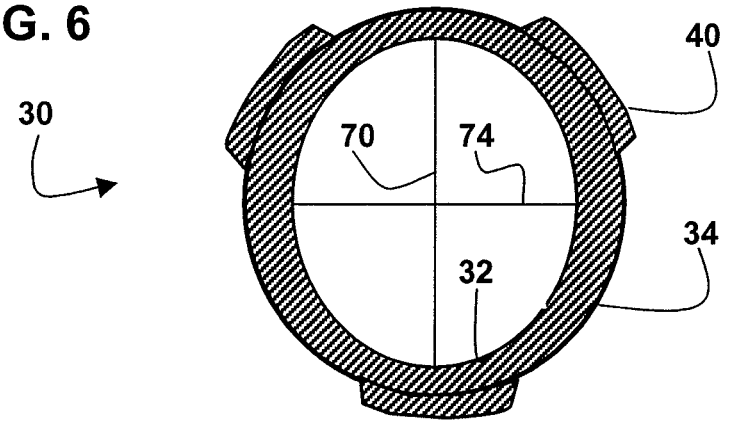
FIG. 6 is a cross-sectional view of an alternative sleeve or outsert of the present invention taken perpendicular to a center longitudinal axis.

The container of FIG. 1 may include an alternative embodiment of the sleeve illustrated in FIGS. 5 and 6. The annular sleeve 30 of this embodiment is positioned about a longitudinal axis and has an inner surface 32. The inner surface 32 of this embodiment is out-of-round, i.e. any shape other than substantially round. Preferably, the inner surface 32 has an out-of-round cross-section along every plane perpendicular to the longitudinal axis. More preferably, the inner surface is substantially elliptical or oval having a major axis 70 and a minor axis 74 along at least one plane perpendicular to the longitudinal axis, most preferably along every plane perpendicular to the longitudinal axis as illustrated in the embodiment of FIG. 6 which does not include beads 36.

An outer surface 34 of this sleeve 30 has a plurality of outwardly projecting lug members 40, preferably 3. The outer surface 34 has a substantially round cross-section along at least one plane perpendicular to the longitudinal axis. Thus, the inner surface 32 and the outer surface 34 have dissimilarly shaped cross-sections. Stated another way, the sleeve 30 has an outer surface 34 opposite an inner surface 32 wherein the inner surface 32 has a cross-sectional shape along every plane perpendicular to the longitudinal axis different or dissimilar from a corresponding cross-sectional shape of the outer surface along the identical plane perpendicular to the longitudinal axis. And more preferably, the outer surface 34 has a substantially round cross-section along at least one plane perpendicular to the longitudinal axis and the inner surface 32 has a substantially oval cross-section shape along at least one plane perpendicular to the longitudinal axis, and the two planes perpendicular to the longitudinal axis are most preferably a single common plane.

It is important to note that the necked-in region 20 of the containment vessel 12 used in combination with the sleeve described in FIGS. 5 and 6 has cross-sectional shape complementary with the cross-sectional shape of the inner surface 32 of the sleeve. In FIG. 5, the inner surface has beads 36 which correspond to captivation members 26 on the containment vessel 13. The preferred version is illustrated in FIG. 6 which does not include beads.

Furthermore, the term "substantially," as used to modify the shapes of the inner and outer surfaces 32,34 of the annular sleeve 30, is intended to encompass minor variations in those surfaces, such as variations to improve gripping of the sleeve 30 on the necked-in region 20 of the containment vessel 12. These variations include small dimples, ribs, indents, and the like having heights or depths which do not substantially modify an overall profile shape of the surfaces or the effective contact surface or surfaces between the inner surface 32 and the necked-in 20 of the container.

One of ordinary skill in the art would appreciate that the terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "joined" and/or "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. A lug-type resealable beverage container, the lug-type resealable beverage container comprising:

a metallic containment vessel having a containment area for receiving a liquid, the containment vessel comprising a closed end separated from an open end by a tubular sidewall joined to a reduced diameter cylindrical portion by a necked-in region, wherein the open end is defined by a radially outwardly rolled flange, and wherein the containment vessel further comprises a radially inwardly extending detent spaced from the flange defining the open end and located on the reduced diameter cylindrical portion;

an annular sleeve joined about the containment vessel, having an uppermost portion adjacent the flange defining the open end and having first and second lug members extending radially outwardly and an inner surface having a radially inwardly extending bead located between and spaced from the uppermost portion of the sleeve and a lowermost portion of the sleeve and fit within the radially inwardly extending detent; and a metallic cap having first and second mating lugs for cooperative engagement with the first and second mating lug members on the sleeve wherein cooperative engagement of the first and second mating lugs with the first and second lug members encloses the liquid within the containment vessel.

2. The lug-type resealable beverage container of claim 1 wherein the radially inwardly extending bead is in cooperative engagement with the radially inwardly extending detent.

3. The lug-type resealable beverage container of claim 2 wherein the reduced diameter cylindrical portion further comprises a second radially inwardly extending detent in cooperative engagement with a second radially inwardly extending bead of the sleeve.

4. The lug-type resealable beverage container of claim 2 wherein the radially inwardly extending bead and the radially inwardly extending detent have complimentary shapes.

5. The lug-type resealable beverage container of claim 4 wherein the radially inwardly extending bead fits completely within the radially inwardly extending detent.

6. The lug-type resealable beverage container of claim 5 wherein portions of the inner surface of the annular sleeve adjacent the radially inwardly extending bead are in engagement with the reduced diameter cylindrical portion.

7. The lug-type resealable beverage container of claim 2 wherein the radially inwardly extending detent has a quadrilateral shape.

8. The lug-type resealable beverage container of claim 7 wherein the quadrilateral shape is a rectangle.

9. The lug-type resealable beverage container of claim 1 wherein the sleeve is produced from a polymeric material.

10. A beverage container, the beverage container comprising:

a metallic containment vessel having a containment area for receiving a liquid, the containment vessel comprising a closed end separated from an open end by a tubular sidewall joined to a reduced diameter cylindrical portion by a necked-in region and a radially inwardly extending detent adjacent the open end located on the reduced diameter cylindrical portion; and an annular sleeve joined about the containment vessel adjacent the open end, the sleeve comprising an inner surface adjacent the containment vessel, the inner surface having a radially inwardly projecting bead located between and spaced from an uppermost portion of the sleeve and a lowermost portion of the sleeve and fit within the radially inwardly extending detent.

11. The beverage container of claim 10 wherein the radially inwardly projecting bead is located entirely within the radially inwardly extending detent.

12. The beverage container of claim 11 wherein a portion of the inner wall adjacent the radially inwardly projecting bead is in engagement with the reduced diameter cylindrical portion.

13. The beverage container of claim 12 wherein the containment vessel further comprises a second radially inwardly extending detent and the sleeve further comprises a second radially inwardly projecting extending bead located entirely within the second radially inwardly extending detent.

14. The beverage container of claim 13 wherein the annular sleeve includes a first and second lug members extending radially outwardly from an outer surface.

15. The beverage container of claim 14 further comprising a cap for covering the open end of the containment vessel, the cap comprising first and second mating lugs for cooperative engagement with the first and second lug members of the annular sleeve, wherein cooperative engagement between the lug members and the mating lugs attaches the cap to the containment vessel.

* * * * *